United States Patent [19]

Von Holt

[11] 3,948,514

[45] Apr. 6, 1976

[54] INDOOR VAULTING BOX

[75] Inventor: Donald C. Von Holt, Quincy, Ill.

[73] Assignee: James A. Von Holt, Qunicy, Ill. ; a part interest

[22] Filed: July 12, 1974

[21] Appl. No.: 488,239

[52] U.S. Cl. ..... 272/59 C

[51] Int. Cl.[2] ..... A63B 5/00

[58] Field of Search ..... 272/59 R, 59 A, 59 C; 273/1.5 R, 26 A, 29 BB, 17 B

[56] References Cited

UNITED STATES PATENTS

| | | | |
|---|---|---|---|
| 1,168,666 | 1/1916 | Medart | 272/59 C |
| 2,818,254 | 12/1957 | Dunn | 273/1.5 R |
| 3,075,765 | 1/1963 | Mpakarakes | 272/59 C |

FOREIGN PATENTS OR APPLICATIONS

| | | | |
|---|---|---|---|
| 923,243 | 4/1963 | United Kingdom | 272/59 C |

*Primary Examiner*—Richard C. Pinkham
*Assistant Examiner*—Joseph R. Taylor
*Attorney, Agent, or Firm*—Clarence A. O'Brien; Harvey B. Jacobson

[57] ABSTRACT

An elongated trough having front and rear ends and including a pair of upstanding opposite side flanges interconnected along their lower marginal edge portions by means of an integral bottom wall extending therebetween is provided. The flanges are convergent toward the rear end of the trough and the bottom wall tapers toward the rear end of the trough. The flanges are upwardly divergent and taper in height toward the front end of the trough. A rear wall extends between and is secured to the rear ends of the flanges and the rear marginal edge of the bottom wall and the rear wall terminates downwardly in an integral horizontally outwardly extending flange projecting outwardly from the rear end of the trough and disposed coplanar with the bottom wall of the trough. The inclined upper edges of the side flanges include outwardly extending flanges terminating outwardly in downturned flanges and the upper marginal edge of the rear wall terminates in a horizontally outwardly projecting rearwardly directed flange terminating outwardly in a downwardly directed flange. The trough is designed as an indoor vaulting box and the inner surface of the rear wall and the upper surface of the bottom wall form an included angle of 105°.

4 Claims, 5 Drawing Figures

INDOOR VAULTING BOX

BACKGROUND OF THE INVENTION

Indoor pole vaulting boxes have been heretofore designed. An example of such previously known indoor pole vaulting box may be found in U.S. Pat. No. 3,075,765. Further, examples of vaulting boxes including similar structure may be found in U.S. Pat. Nos. 1,168,666 and 2,110,254.

BRIEF DESCRIPTION OF THE INVENTION

The pole vaulting box of the instant invention defines a forwardly opening and rearwardly tapering trough closed at its rear end and including upwardly divergent side flanges. Further, the vaulting box is adapted to be utilized on substantially any inside floor surface and is constructed in a manner whereby it may be secured in operative position without the use of floor anchors and merely by the use of weight structures placed to the rear of the box in position overlying a lower floor engaging and rearwardly projecting flange of the box.

The main object of this invention is to provide an indoor vaulting box to enable a pole vaulter to be afforded the opportunity to practice when ground and weather conditions outside are unfavorable.

Another object of this invention is to provide an indoor vaulting box which may be readily used indoors on a basketball gymnasium floor or on other suitable horizontal surfaces and which may be anchored in position merely through the utilization of weight objects specifically positioned relative to the box.

Yet another object of this invention is to provide an indoor vaulting box which may also be readily secured in position by placing the rear of the vaulting box a spaced distance from a gymnasium wall or the like and utilizing a generally rectangular frame between the rear end of the box and the associated gymnasium wall.

Yet another object of this invention is to provide an indoor vaulting box or trough which presents minimal obstruction to the lower end of a pole vaulting pole sliding along the surface upon which the box is disposed toward and into the forward end of the box.

Another object of this invention to be specifically enumerated herein is to provide a pole vaulting box which will conform to conventional forms of manufacture, be of simple construction and easy to use so as to provide a device that will be economically feasible, long lasting and relatiively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
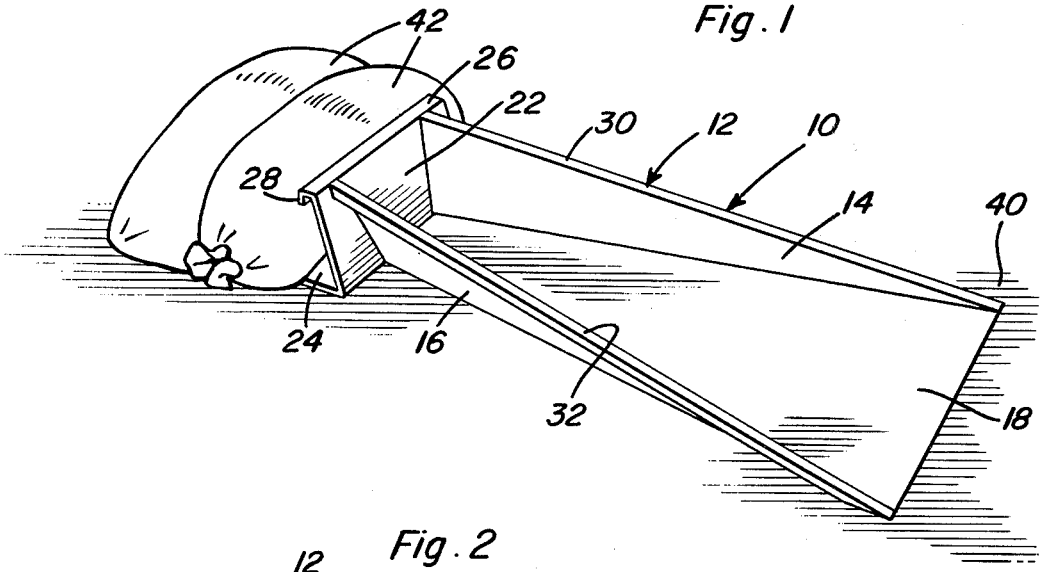
FIG. 1 is a perspective view of the vaulting box with weight bags disposed to the rear of the box and at least one of the weight bags resting upon the rearwardly projecting flange formed integrally with the lower marginal edge of the rear of the box.

Referring now more specifically to the drawings, the numeral 10 generally designates the vaulting box of the instant invention. The box 10 includes a trough-like structure or assembly referred to in general by the reference numeral 12. The assembly 12 includes a pair of opposite side upstanding flanges 14 and 16 and a horizontal bottom wall or flange 18 extends between and is formed integrally with the lower marginal edges of the flanges 14 and 16.

Figure 2:
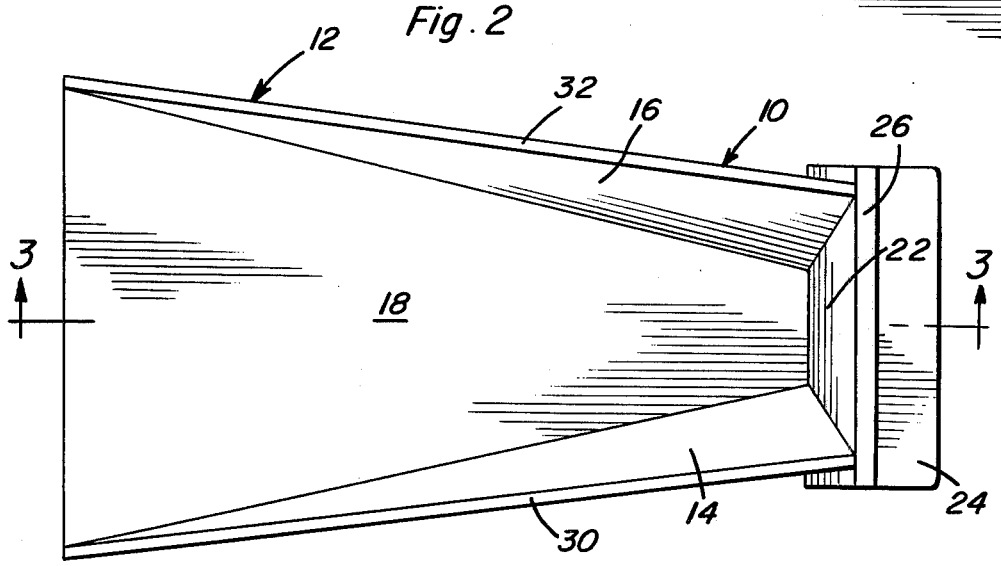
FIG. 2 is an enlarged top plan view of the box.
Figure 4:
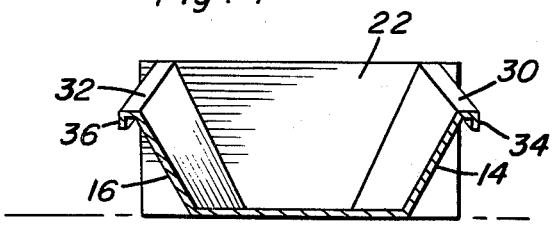
FIG. 4 is a transverse vertical sectional view as seen from the forward end of the box.
Figure 5:
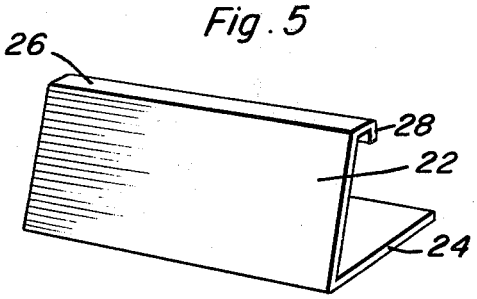
FIG. 5 is a perspective view of the rear wall and rearwardly projecting anchoring flange portion of the rear wall with the latter detached from the remainder of the vaulting box.

From FIGS. 1, 2 and 4 of the drawings it may be seen that the bottom wall 18 tapers rearwardly and that the flanges 14 and 16 are rearwardly convergent. Further, the longitudinal opposite side flanges 14 and 16 are upwardly divergent and inclined from the vertical approximately 30 degrees.

The rear end of the assembly 12 is closed by means of an upstanding rear wall or flange 22 and the lower marginal edge of the rear wall or flange 22 includes an integral rearwardly directed horizontal flange 24 for a purpose to be hereinafter more fully set forth. The upper marginal edge of the rear wall 22 includes a rearwardly directed flange 26 which in turn terminates rearwardly in a downturned flange 28. Also, the upper edges of the side walls or flanges 14 and 16 terminate in horizontally outwardly directed flanges 30 and 32 and the flanges 30 and 32 terminate outwardly in downturned flanges 34 and 36.

Figure 3:
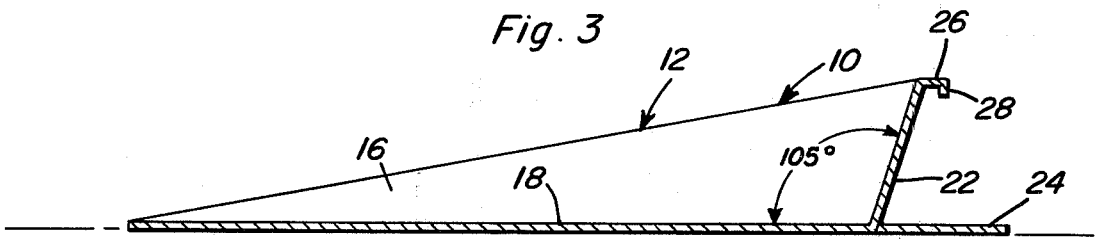
FIG. 3 is a longitudinal vertical sectional view taken substantially upon the plane indicated by the section line 3—3 of FIG. 2.

The side flanges 14 and 16 and the bottom wall 18 are formed from a single piece of 14 gauge sheet metal having a thickness of .095 inch and the rear wall 22 and the flange 24 are integrally formed from 14 gauge sheet metal. The rear edges of the flanges 14 and 16 as well as the rear marginal edge of the bottom wall 18 are secured to the rear wall 22 by welding. Further, it may be seen from FIG. 3 of the drawings that the inner surface of the rear wall 22 and the upper surface of the bottom wall 18 form an included angle of 105 degrees.

The bottom wall 18 is planar throughout its entire plan area and approximately 40 inches in length, 6 inches in width at its minor end and 24 inches in width at its major end. Also, the vertical height of the rear ends of the flanges 14 and 16 is approximately 8 inches and the outwardly projecting extent of the flange 24 is approximately 6 inches while its transverse length is approximately 5¼ inches. Further, the flanges 30, 32 and 26 are approximately 1¼ inches in width and the downturned flanges 34, 36 and 28 are approximately ½ inch in width.

It will be noted that the rear ends of the flanges 30 and 32 are substantially flush with the flange 26 and it is to be understood that in addition to the rear edges of the flanges 14 and 16 and the rear marginal edge of the bottom wall 18 being welded to the rear wall 28 the rear ends of the flanges 30, 32, 34 and 36 are also welded to the rear wall 22.

In operation, the vaulting box 10 may be secured in position on a suitable flooring surface 40 through the utilization of sandbags 42 or the like positioned behind the rear wall portion 22 with at least one of the sandbags 42 resting upon the flange 24. In addition, if the rear wall 22 of the vaulting box 10 faces but is spaced from a wall of a gymnasium, a suitable rectangular frame or the like may be placed between the rear face of the rear wall 22 and the gymnasium wall to prevent rearward movement of the vaulting box 10 during use.

Inasmuch as the bottom wall 18 is only 0.095 inch in thickness, should a practicing vaulter let the forward end of his pole contact the flooring 40 before being received within the trough 10, the forward edge of the bottom wall 18 will not present such a barrier to prevent the forward end of the vaulting pole from entering the box or trough 10. Also, the upwardly divergent and rearwardly convergent flanges 14 and 16 assist in centerirng the forward end of the vaulting pole in the rear end of the trough 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An indoor vaulting box defining an elongated trough constructed from a single generally rectangular sheet of metal having open front and rear ends and creased along transversely spaced longitudinal zones convergent toward the rear end of said sheet to define a pair of upstanding upwardly divergent opposite side flanges convergent toward the rear end of said sheet and interconnected along their lower marginal edge portions by means of an integral planar bottom wall extending therebetween and tapering in width toward said rear end of said sheet, said flanges further tapering in height toward said front end of said sheet, said box also including an upstanding rear wall extending and secured between the upstanding rear ends of said flanges and the rear marginal edge of said bottom wall, said rear wall terminating downwardly in an integral horizontally outwardly extending flange projecting outwardly from the rear end of said trough, and coplanar with said bottom wall and of sufficient planar extent for receiving at least one weighted sandbag thereon to anchor said vaulting box against appreciable movement in use, the upstanding rear marginal edges of said side flanges being contained in a rearwardly and upwardly inclined plane, said rear wall being substantially coplanar with said plane.

2. The combination of claim 1 wherein the upper marginal edges of said side flanges terminate upwardly in integral outturned horizontal flanges, the end edges of said outturned flanges at the rear ends of said side flanges being flush with and secured to the adjacent upper marginal edge portions of said rear wall.

3. The combination of claim 2 wherein said outturned flanges terminate outwardly in downturned flanges, the ends of said downturned flanges adjacent said end wall also being secured to the latter.

4. The combination of claim 1 wherein the upper marginal edge portion of said rear wall terminates in an integral horizontally outwardly and rearwardly projecting flange terminating rearwardly in a downturned flange.

* * * * *